United States Patent [19]

Baker et al.

[11] 4,191,383

[45] Mar. 4, 1980

[54] INFLATABLE PACKER AND METHOD OF CONSTRUCTING SAME

[75] Inventors: Eugene E. Baker; Ernest E. Carter, Jr., both of Duncan, Okla.

[73] Assignee: Halliburton Company, Duncan, Okla.

[21] Appl. No.: 8,773

[22] Filed: Feb. 2, 1979

[51] Int. Cl.[2] ..... F16J 15/40; F16J 15/46

[52] U.S. Cl. ..... 277/1; 285/297; 277/9; 277/34.6; 277/116.2; 277/121; 277/230

[58] Field of Search ..... 285/294, 297; 277/1, 277/9, 9.5, 34, 34.6, 116.2, 116.6, 120, 121, 230

[56] References Cited

U.S. PATENT DOCUMENTS

| | | | |
|---|---|---|---|
| 2,611,437 | 9/1952 | Lynes | 277/34.6 |
| 3,053,322 | 9/1962 | Kline | 277/34.6 |
| 3,085,628 | 4/1963 | Malone | 277/34 |
| 3,437,142 | 4/1969 | Conover | 277/34 X |
| 3,542,127 | 11/1970 | Malone | 277/34 X |
| 3,604,732 | 9/1971 | Malone | 277/34 X |
| 3,837,947 | 9/1974 | Malone | 277/34 X |
| 4,153,656 | 5/1979 | Bunyan | 285/294 X |

*Primary Examiner*—Robert S. Ward, Jr.

*Attorney, Agent, or Firm*—John A. Tregoning; James R. Duzan; Lucian Wayne Beavers

[57] ABSTRACT

The inflatable packer element of the present invention includes an inflatable bladder means having a braided wire reinforcing element. An end of the reinforcing element is received between a tapered surface of an annular anchor means and a tapered surface of an annular wedge means. A threaded portion of the anchor means engages a threaded portion of an annular ring. The wedge means is slidably received within the annular ring and engages an abutment of the ring, so that when the threaded connection between the anchor means and the annular ring is made up the reinforcing element is clamped between the tapered surfaces. An additional clamping force is then applied by applying liquid epoxy under pressure against the wedge means to further drive it toward the anchor means and increase the clamping force on the reinforcing element. The pressure is maintained until the epoxy is hardened. The joint is then further strengthened by forcing additional liquid epoxy into the area between the reinforcing element and the tapered surface of the anchor means to bond the reinforcing element to the anchor means.

18 Claims, 4 Drawing Figures

INFLATABLE PACKER AND METHOD OF CONSTRUCTING SAME

This invention relates generally to an inflatable packer assembly for sealing an annular cavity about a well casing or other tubular element, and more particularly, but not by way of limitation, to an improved means for connecting the ends of a reinforced inflatable bladder to annular members at the ends of the packer assembly.

An inflatable packer is a downhole tool which can be inflated with well fluid to seal off the annular space between, for example, the casing and the wellbore. It may also be used inside a casing.

Inflatable packers may be used in a well for a variety of reasons. They can be used to support a column of cement above a lost circulation zone. They can be used to isolate producing zones from cement contact. At times they are used to centralize a casing during cementing operations. Also, they may be used to isolate production and lost circulation zones for gravel pack operations.

Inflatable packers of the prior art typically provide for connecting a reinforcing element of the inflatable bladder to annular members at the ends of the packer by clamping the ends of the reinforcing element between two tapered surfaces. The two tapered surfaces are mechanically urged together by making up a threaded connection. Typical examples of such prior art apparatus include U.S. Pat. No. 3,437,142 to Conover, No. 3,160,211 to Malone, No. 3,085,628 to Malone and No. 2,778,432 to Allen.

A continuing problem with these prior art apparatus is the failure of the connection between the reinforcing element of the bladder means and the annular members at the ends of the packer.

The present invention greatly improves the strength of this connection by providing a hydraulic wedging action in addition to the initial mechanical wedging action and by the use of liquid adhesive to bond the reinforcing element to the annular member.

The inflatable packer element of the present invention includes an inflatable bladder means having a braided wire reinforcing element. An end of the reinforcing element is received between a tapered surface of an annular anchor means and a tapered surface of an annular wedge means. A threaded portion of the anchor means engages a threaded portion of an annular ring. The wedge means is slidably received within the annular ring and engages an abutment of the ring, so that when the threaded connection between the anchor means and the annular ring is made up the reinforcing element is clamped between the tapered surfaces. An additional clamping force is then applied by applying liquid epoxy under pressure against the wedge means to further drive it toward the anchor means and increase the clamping force on the reinforcing element. The pressure is maintained until the epoxy is hardened. The joint is then further strengthened by forcing additional liquid epoxy into the area between the reinforcing element and the tapered surface of the anchor means to bond the reinforcing element to the anchor means.

Figure 1A:
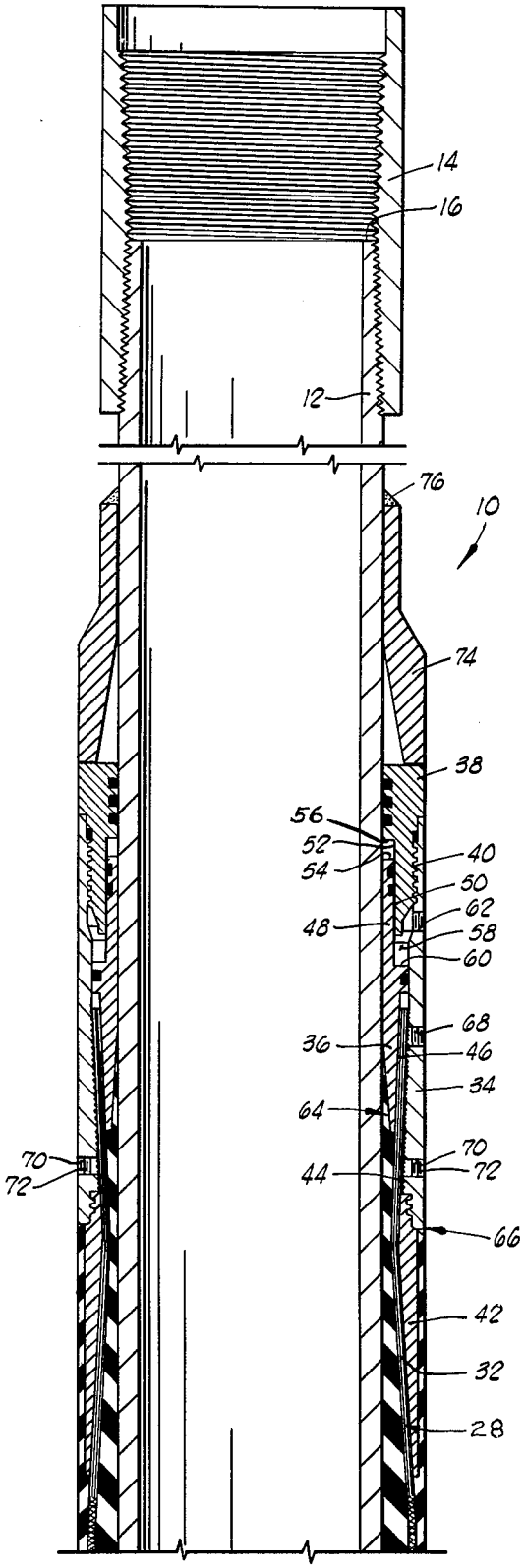
FIGS. 1A–1C are a sectional elevation view of the inflatable packer assembly of the present invention.
Figure 1B:
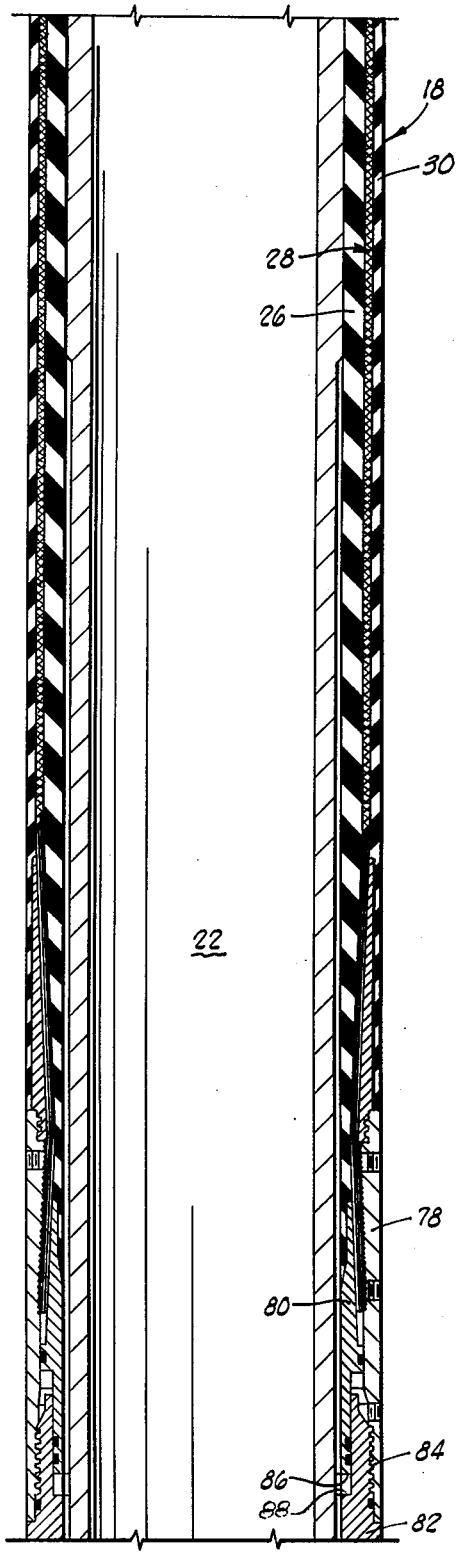
Figure 1C:
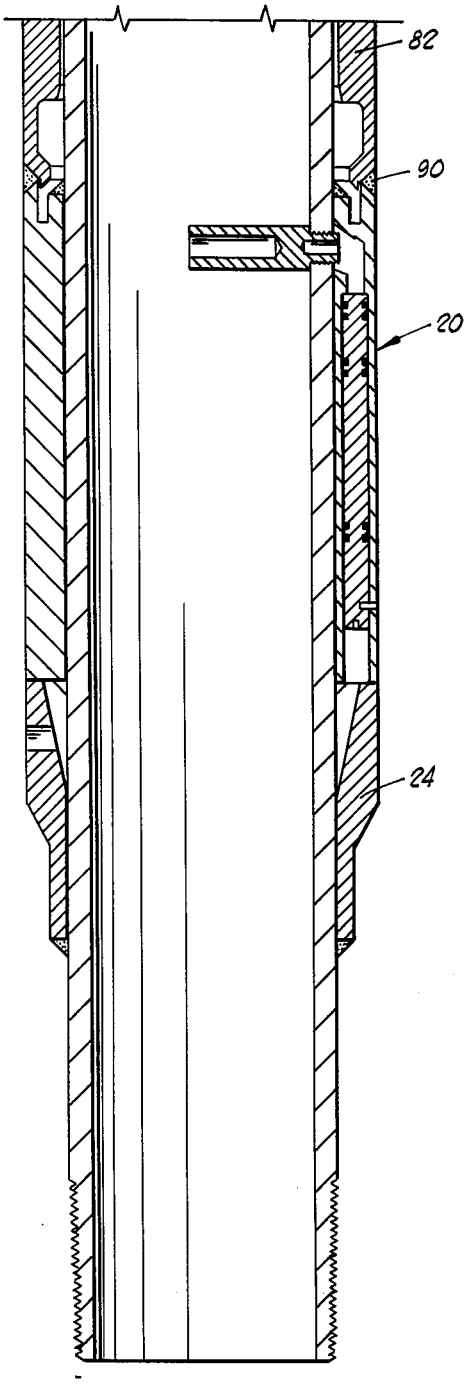

Referring now to the drawings and particularly to FIG. 1 the inflatable packer assembly of the present invention is shown and generally designated by the numeral 10. The inflatable packer assembly 10 includes a tubular mandrel 12 which has an upper body 14 threadedly connected to its upper end 16.

An inflatable packer element generally designated by the numeral 18 is disposed about mandrel 12.

A control valve means generally designated by the numeral 20 is disposed about the mandrel 12 below and connected to packer element 18. The control valve 20 selectively supplies fluid under pressure from an interior 22 of mandrel 12 to the inflatable packer element 18 for inflating the same. A lower end of control valve 20 abuts a lower backup ring 24. The inflatable portion of packer element 18 includes a radially inner bladder means 26 which is surrounded by a braided steel cable reinforcing element 28. A radially outer rubber covering 30 protects the braided steel element 28.

The inner bladder means 26 is preferably comprised of a plurality of layers of rubber which are separated from the braided reinforcing element 28 by a layer of nylon.

Referring to the upper end of the packer element 18, an upper end portion 32 of reinforcing element 28 does not have the steel cables braided but rather they are laid in parallel. The parallel wire portion 32 is illustrated by parallel lines as opposed to the criss-cross marking of the braided portion of reinforcing element 28. The reinforcing element 28 is seen to be clamped between an annular upper anchor means 34 and an annular upper wedge means 36. Anchor means 34 includes a theaded portion which is in turn connected to a threaded portion of an upper packer shoe or annular ring 38 at threaded connection 40. Connected to a lower end of upper anchor means 34 is an upper brass expanding sleeve 42.

Upper anchor means 34 includes an axially downward tapered inner surface 44 which is threaded so as to provide an irregular surface means for gripping reinforcing element 28.

The upper annular wedge means 36 includes an annular axially downward tapered outer surface 46. Anchor means 34 and wedge means 36 are so arranged that the wires or cables of the reinforcing element 28 are located between said tapered surfaces 44 and 46.

Annular wedge means 36 includes an cylindrical portion 48 having an outer cylindrical surface 50 which is slidably received within a cylindrical bore 52 of upper packer shoe 38.

When the threaded connection 40 is first made up an upper end 54 of cylindrical portion 48 engages an abutment 56 of upper packer shoe 38. As the threaded connection 40 is made up the wedge means 36 is urged downwards so that the tapered surface 46 of wedge means 36 is urged toward the tapered surface 44 of anchor means 34 so that the ends of the wires of the reinforcing element 28 are clamped between said tapered surfaces 44 and 46.

Anchor means 34, annular ring or upper packer shoe 38, and wedge means 36 define an annular fluid tight chamber 58 communicating with a surface 60 of wedge means 36, which surface 60 is characterized as facing away from the downward direction of the axial taper of surface 46 of wedge means 36.

Figure 2:
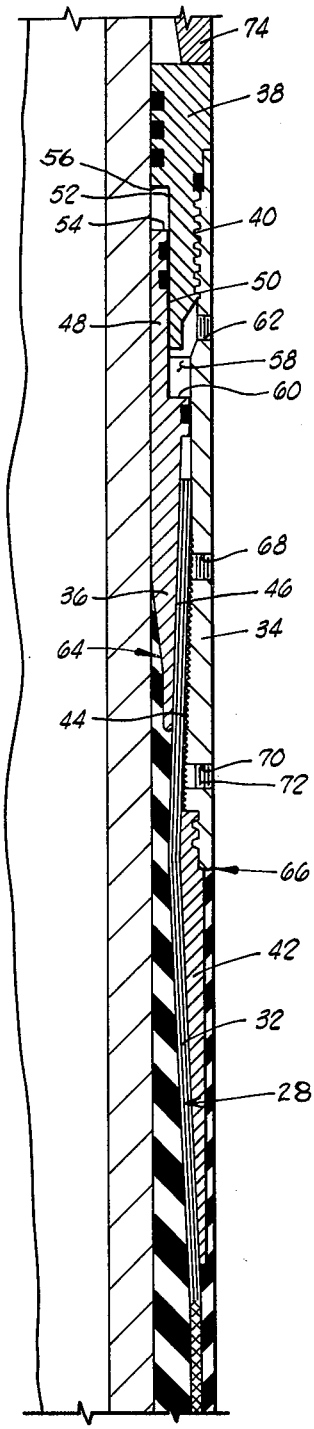
FIG. 2 is an enlarged view of the connection between the end of the reinforcing element and the annular members at the upper end of the packer.

A threaded hole 62 is disposed through a wall of anchor means 34 so as to provide a means for connecting a supply of hydraulic pressure to said annular chamber 58. When hydraulic pressure is applied to said annular chamber 58 the force being applied against surface 60 urges wedge means 36 downwardly in the direction of its axial taper so as to further urge tapered surfaces 44 and 46 together to further clamp the ends of the wires or cables of reinforcing element 28 therebetween. The end 54 of wedge means 36 is moved away from abutment 56 as shown in FIG. 2.

Preferably a supply of liquid epoxy under pressure in connected to hole 62 so that said liquid epoxy under pressure is directed into chamber 58. The liquid epoxy should be maintained under pressure against said wedge means 36 until said epoxy is hardened so that annular chamber 58 is filled with hardened epoxy and the wedge means 36 is therefore retained in such a position that it clamps the ends of the wire elements of the reinforcing element 28 between the tapered surfaces 44 and 46. The hole 62 is then plugged with a conventional pipe plug to provide a fluid seal.

Preferably the tapered surface 44 of anchor means 34 includes an irregular surface for assisting in gripping the wire elements of the reinforcing element 28. The irregular surface of tapered surface 34 is formed by a conventional internal thread, but an irregular surface could be provided by any number of other means and the threaded surface 44 is, of course, not actually threaded with the reinforcing element 28.

After inflatable packer assembly 10 has been assembled as shown, and the liquid epoxy has been allowed to harden in annular chamber 58, the rubber components of the bladder or packer 18 are cured so that the inner bladder means 26 bonds to the steel wedge means 36 at the surface indicated as 64, and so that the rubber cover 30 bonds to the steel anchor means as indicated at 66.

After the rubber components have been cured it is desirable to force additional liquid epoxy resin into the area between the ends of the wires of reinforcing element 28 and the tapered surface 44 of anchor means 34 so as to provide for additional strength of the connection between reinforcing element 28 and anchor means 34.

To that end an inlet port means 68 is disposed through said anchor means 34, and communicates with said area between said ends of the wires of the reinforcing element 28 and the tapered surface 44 of anchor means 34. Inlet port means 68 provides a means for connecting a source of liquid adhesive, which is preferably epoxy, under pressure to said area.

An outlet port means 70, axially spaced from said inlet port means 68, is also disposed through said anchor means 34 and communicates with said area between said wires and said tapered surface 44. Outlet port means 70 provides a means for venting said area so that liquid adhesive may flow into said inlet port means 68, across said area between the ends of the wires of the reinforcing element 28 and the tapered surface 44 of anchor means 34, and out said outlet port means 70.

Preferably there is only one inlet port 68, and there are a plurality of outlet ports 70 radially spaced about said anchor means 34. In this manner the liquid adhesive may be introduced into inlet port 68 and allowed to flow successively to the various outlet ports 70. Once liquid adhesive begins to flow out the outlet port 70 closest to the inlet port 68, that outlet port is closed with a conventional pipe plug 72 so that the liquid adhesive is forced towards the other outlet ports. Similarly as liquid adhesive begins to flow out each of the other outlet ports that port is closed with a pipe plug 72 until the entire annular area between the ends of the wire of the reinforcing element 28 and the annular tapered surface 44 is saturated with liquid adhesive.

When the inflatable packer assembly 10 is in the uninflated position, as illustrated, the upper packer shoe 38 engages in upper backup ring 74 which is welded to mandrel 12 at 76.

Referring now to the lower end of the bladder or packer 18, the lower ends of the wires of the reinforcing element 28 are clamped between a lower anchor means 78 and a lower wedge means 80 in a manner similar to that in which the upper ends were clamped between the upper anchor means 34 and the upper wedge means 36.

The lower anchor means 78 is connected to a lower annular ring or packer shoe 82 at threaded connection 84 in a manner similar to the connection between upper anchor means 34 and upper annular ring 38.

Similarly a lower end 86 of lower wedge means 80 engages an abutment 88 of lower annular ring 82. The lower annular ring 82 is welded to control valve means 20 as indicated at 90.

The inflatable packer assembly is preferrably constructed in the following manner. An end of reinforcing element 28 is placed between tapered surfaces 44 and 46 of anchor means 34 and wedge means 36, respectively. Then threaded connection 40 is made up to provide an initial clamping force between the tapered surfaces.

A source of liquid adhesive under pressure is connected to threaded hole 62 and a liquid adhesive under pressure is applied to annular chamber 58 to urge tapered surface 46 toward tapered surface 44. The adhesive is preferably an epoxy. The pressure of said liquid adhesive is maintained in annular chamber 58 until the adhesive hardens so that reinforcing element 28 remains clamped between tapered surfaces 44 and 46. This is done by introducing the epoxy through a conventional grease zert with an integral check valve.

Then the rubber bladder 26 and outer rubber covering 30 are cured so that they bond to wedge means 36 and anchor means 34 at 64 and 66, respectively.

Finally, additional liquid adhesive is forced into inlet port 68, and across the area between the reinforcing element 28 and tapered surface 44, and out outlet port 70. This greatly strengthens the joint between the reinforcing element 28 and anchor means 34.

Thus, the inflatable packer assembly of the present invention is well adapted to obtain the objects and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An inflatable packer element, comprising:

an inflatable bladder means including a reinforcing element;

an annular anchor means having an axially tapered surface;

an annular wedge means having an axially tapered surface, said bladder means, anchor means and wedge means being so arranged that an end of said reinforcing element is located between said tapered surfaces of said anchor means and said wedge means; and means for applying hydraulic pressure to said wedge means to urge said tapered surface of said wedge means toward said tapered surface of said anchor means so that said end of said reinforcing element is clamped between said tapered surfaces.

2. Apparatus of claim 1, wherein said means for applying hydraulic pressure is further characterized as a means for applying a liquid adhesive under pressure against said wedge means to urge said tapered surface of said wedge means toward said tapered surface of said anchor means, and for maintaining said adhesive under pressure against said wedge means until said adhesive is hardened so that said reinforcing element remains clamped between said tapered surfaces.

3. Apparatus of claim 2, wherein:

one of said tapered surfaces includes an irregular surface means for gripping said end of said reinforcing element; and said apparatus further comprises a means for forcing liquid adhesive between said wires and said irregular surface.

4. Apparatus of claim 2, further comprising a threaded connection between said anchor means and said wedge means, so arranged that when said threaded connection is made up said tapered surface of said wedge means is urged toward said tapered surface of said anchor means to provide an initial clamping action between said tapered surfaces.

5. Apparatus of claim 1, further comprising a threaded connection between said anchor means and said wedge means, so arranged that when said threaded connection is made up said tapered surface of said wedge means is urged toward said tapered surface of said anchor means to provide an initial clamping action between said tapered surfaces.

6. Apparatus of claim 1, wherein:

one of said tapered surfaces includes an irregular surface means for gripping said end of said reinforcing element; and said apparatus further comprises a means for forcing liquid adhesive between said reinforcing element and said irregular surface.

7. Apparatus of claim 1, further comprising a means for forcing liquid adhesive between said reinforcing element and said tapered surface of said anchor means.

8. An inflatable packer element, comprising:

an inflatable bladder means including a reinforcing element;

an annular anchor means having an axially tapered surface, and including a threaded portion;

an annular ring having a threaded portion engaging said threaded portion of said anchor means;

an annular wedge means, slidably received by said annular ring and engaging an abutment of said ring, said wedge means including an axially tapered surface so arranged that when said threaded connection between said annular anchor means and said annular ring is made up an end of said reinforcing element is clamped between said tapered surfaces of said anchor means and said wedge means; and a means for applying hydraulic pressure to said wedge means to urge said tapered surface of said wedge means toward said tapered surface of said anchor means to increase the clamping force on said end of said reinforcing element.

9. Apparatus of claim 8, wherein:

said anchor means, said annular ring, and said wedge means define an annular fluid tight chamber communicating with a surface of said wedge means, said surface facing away from a direction of said axial taper of said wedge means; and said means for applying hydraulic pressure to said wedge means includes a means for applying hydraulic pressure to said annular chamber so that said wedge means is urged in said direction of said axial taper of said tapered surface thereof.

10. Apparatus of claim 9, wherein said means for applying hyraulic pressure is further characterized as a means for applying a liquid adhesive under pressure to said annular chamber, and for maintaining said adhesive under pressure until said adhesive is hardened so that said reinforcing element remains clamped between said tapered surfaces.

11. Apparatus of claim 8, further comprising a means for forcing liquid adhesive into an area between said reinforcing element and said tapered surface of said anchor means after said hydraulic pressure is applied to said wedge means.

12. Apparatus of claim 11, wherein said means for forcing liquid adhesive between said reinforcing element and said tapered surface includes:

an inlet port means, disposed through said anchor means and communicating with said area between said reinforcing element and said tapered surface of said anchor means, for connecting a source of liquid adhesive under pressure to said area; and an outlet port means, disposed through said anchor means and communicating with said area, said outlet port means being axially spaced from said inlet port means, for venting said area so that liquid adhesive may flow into said inlet port means, across said area, and out said outlet port means.

13. Apparatus of claim 12, wherein said outlet port means includes a plurality of outlet ports radially spaced about said anchor means.

14. A method of constructing an inflatable packer element, said method comprising the steps of:

placing an end of a reinforcing element of an inflatable bladder means between axially tapered surfaces of an annular anchor means and an annular wedge means; and applying hydraulic pressure to said wedge means to urge said tapered surface of said wedge means toward said tapered surface of said anchor means to clamp said end of said reinforcing element between said tapered surfaces.

15. The method of claim 14, wherein:

said step of applying hydraulic pressure is further characterized as applying a liquid adhesive under pressure against said wedge means to urge said tapered surface of said wedge means toward said tapered surface of said anchor means; and said method further comprises the step of maintaining said liquid adhesive under pressure against said wedge means until said adhesive hardens so that said reinforcing element remains clamped between said tapered surfaces.

16. The method of claim 15, further comprising the step of making up a threaded connection to urge said tapered surface of said wedge means toward said tapered surface of said anchor means to provide an initial clamping force on said end of said reinforcing element prior to the application of said hydraulic pressure to said wedge means.

17. The method of claim 16, further comprising the step of forcing liquid adhesive between said end of said reinforcing element and said tapered surface of said anchor means.

18. The method of claim 17, further comprising the step of curing a rubber bladder of said bladder means to bond said rubber bladder to said wedge means prior to said step of forcing liquid adhesive between said end of said reinforcing element and said tapered surface of said anchor means.

* * * * *